US011353181B1

(12) United States Patent
Mishan

(10) Patent No.: US 11,353,181 B1
(45) Date of Patent: Jun. 7, 2022

(54) SOLAR DISK LIGHT WITH SELECTABLE COLOR TEMPERATURE

(71) Applicant: E. MISHAN & SONS, INC., New York, NY (US)

(72) Inventor: Jeffrey Mishan, New York, NY (US)

(73) Assignee: E. Mishan & Sons, Inc., New York, NY (US)

( * ) Notice: Subject to any disclaimer, the term of this patent is extended or adjusted under 35 U.S.C. 154(b) by 0 days.

(21) Appl. No.: 17/382,900

(22) Filed: Jul. 22, 2021

(51) Int. Cl.

| | |
|---|---|
| ***F21S 8/08*** | (2006.01) |
| ***F21S 9/03*** | (2006.01) |
| ***F21V 23/04*** | (2006.01) |
| ***F21V 9/45*** | (2018.01) |
| ***F21V 21/08*** | (2006.01) |
| ***F21Y 113/13*** | (2016.01) |
| ***F21Y 115/10*** | (2016.01) |

(52) U.S. Cl.
CPC ..... *F21S 8/081* (2013.01); *F21S 9/037* (2013.01); *F21V 9/45* (2018.02); *F21V 21/0824* (2013.01); *F21V 23/0435* (2013.01); *F21V 23/0464* (2013.01); *F21Y 2113/13* (2016.08); *F21Y 2115/10* (2016.08)

(58) Field of Classification Search
CPC .. F21S 8/081; F21V 9/45; F21V 9/037; F21V 21/0824; F21V 23/0435; F21V 23/0464; F21Y 2113/13; F21Y 2115/10
See application file for complete search history.

(56) References Cited

U.S. PATENT DOCUMENTS

2004/0105264 A1* 6/2004 Spero ..... B60Q 1/085 362/276
2019/0128486 A1* 5/2019 Hollinger ..... F21S 9/037

* cited by examiner

*Primary Examiner* — Mary Ellen Bowman
(74) *Attorney, Agent, or Firm* — Notaro, Michalos & Zaccaria P.C.

(57) ABSTRACT

A solar disk light has a disk light body, the disk light body including a housing and a lid over the housing, the housing being hollow to contain components of the disk light. The disk light body has solar cells on an outer surface thereof for harvesting solar energy and detecting ambient light, and LEDs for emitting light. The LEDs are adapted to be selectively driven to emit cool temperature light or warm temperature light. The wiring and driver electronics configured to deliver electrical power to the LEDs from the battery, and configured to drive some or all of the LEDs to emit warm light or cool light depending on a switch setting or signals received from a remote-control transmitter.

10 Claims, 9 Drawing Sheets

SOLAR DISK LIGHT WITH SELECTABLE COLOR TEMPERATURE

FIELD AND BACKGROUND OF THE INVENTION

The subject technology relates to small solar-powered lighting devices for portable or landscape use.

SUMMARY OF THE INVENTION

According to an aspect of the subject technology, a portable or landscape lamp or luminaire for illumination or decorative lighting consists of a self-contained light source, for example a disk light, including a disk light body, which is hollow to contain certain operative elements of the light, light-emitting diodes (LEDs) disposed on the top of the disk light body, solar cells for collecting solar energy to power the LEDs and disposed on a roof of the disk light body, a rechargeable battery for storing energy collected by the solar cells disposed within the disk light body, and driver circuitry to power the LEDs with the stored energy, and a three-position slide switch.

In an embodiment, the LEDs are dual-color-temperature LEDs, i.e., LED emitters capable of emitting light of a first color temperature, and a second color temperature different from the first color temperature, depending on how they are driven by the driver electronics. In another embodiment, a first set of LEDs has a first color temperature, and a second set of LEDs has a second color temperature different from the first color temperature.

The driver circuitry is configured to operate the disk light in three modes: an OFF mode in which all LEDs are off, a COOL mode in which some or all of the LEDs are driven to emit cool color temperature light, and a WARM mode in which some or all the LEDs are driven to emit warm color temperature light.

For use as a landscape light, a mounting spike is attached to the disk light body, for affixing the lighting fixture to the ground. The mounting spike is preferably removable from the frame and consists of two interlocking blades. Each blade has integrally formed attachment arms for attaching the blade to the disk light body.

In a non-limiting embodiment, a solar disk light comprises a disk light body, the disk light body comprising a housing and a lid over the housing, the housing being hollow to contain components of the disk light. The disk light body has solar cells on an outer surface thereof for harvesting solar energy and detecting ambient light, and LEDs for emitting light. The LEDs are adapted to be selectively driven to emit cool temperature light or warm temperature light. The disk light body contains lighting components comprising a rechargeable battery for storing harvested solar energy, a switch having an OFF position, a COOL position, and a WARM position for enabling and disabling electrical power delivery to the LEDs from the battery and for selecting the emission of cool temperature light or warm temperature light, and wiring and driver electronics for operably connecting the solar cells, battery, switch, and LEDs. The wiring and driver electronics are configured to deliver electrical power to the LEDs from the battery, and configured to drive some or all of the LEDs to emit cool temperature light when the switch is in the COOL position and the solar cells are not detecting ambient light, and configured to drive some or all of the LEDs to emit warm temperature light when the switch is in the WARM position and the solar cells are not detecting ambient light, and to cut off power to the LEDs when the switch is in the OFF position or the solar cells are detecting ambient light.

In a further non-limiting embodiment, a disk light is as in the preceding paragraph, except that the disk light has a two position (ON-OFF) switch instead of the three-position switch, and has a remote-control receiver for receiving remote-control signals from a remote-control transmitter configured to send remote-control signals to the remote-control receiver, the remote-control signals including an ON remote-control signal, a COOL remote-control signal, a WARM remote-control signal, and an OFF remote-control signal. The wiring and driver electronics are configured to deliver electrical power to the LEDs from the battery, and configured to drive some or all of the LEDs to emit cool temperature light when the switch is in the ON position and the solar cells are not detecting ambient light and the remote-control receiver has received a COOL remote-control signal from the remote-control transmitter, and configured to drive some or all of the LEDs to emit warm temperature light when the switch is in the ON position and the solar cells are not detecting ambient light and the remote-control receiver has received a WARM remote-control signal from the remote-control transmitter, and to cut off power to the LEDs when the switch is in the OFF position or the solar cells are detecting ambient light or the remote-control receiver has received an OFF remote-control signal from the remote-control transmitter.

In a further non-limiting embodiment, some or all of the LEDs are dual-color-temperature LEDs, capable of emitting cool light or warm light, depending on how they are driven by the driver electronics.

In a further non-limiting embodiment, some or all of the LEDs are warm light LEDs which are driven and illuminated to emit warm light, and other LEDs are cool light LEDs which are driven and illuminated to emit cool light.

In a further non-limiting embodiment, the disk light further comprises a landscape spike removably attached to the disk light body, the landscape spike configured for insertion into the ground, thereby affixing the solar disk light to the ground.

In a further non-limiting embodiment, a kit for making a solar disk light assembly, comprises a solar disk light as previously described, and a pair of blades configured to be interlocked together to form a landscape spike which is configured to be removably attached to the disk light body and also configured for insertion into the ground, thereby affixing the solar disk light to the ground.

In a further non-limiting embodiment, the kit further includes a remote-control transmitter, configured as previously described.

The various features of novelty which characterize the subject technology are pointed out with particularity in the claims annexed to and forming a part of this disclosure. For a better understanding of the subject technology, its operating advantages and specific objects attained by its uses, reference is made to the accompanying drawings and descriptive matter in which preferred embodiments of the subject technology are illustrated.

DETAILED DESCRIPTION OF THE INVENTION

Figure 1:
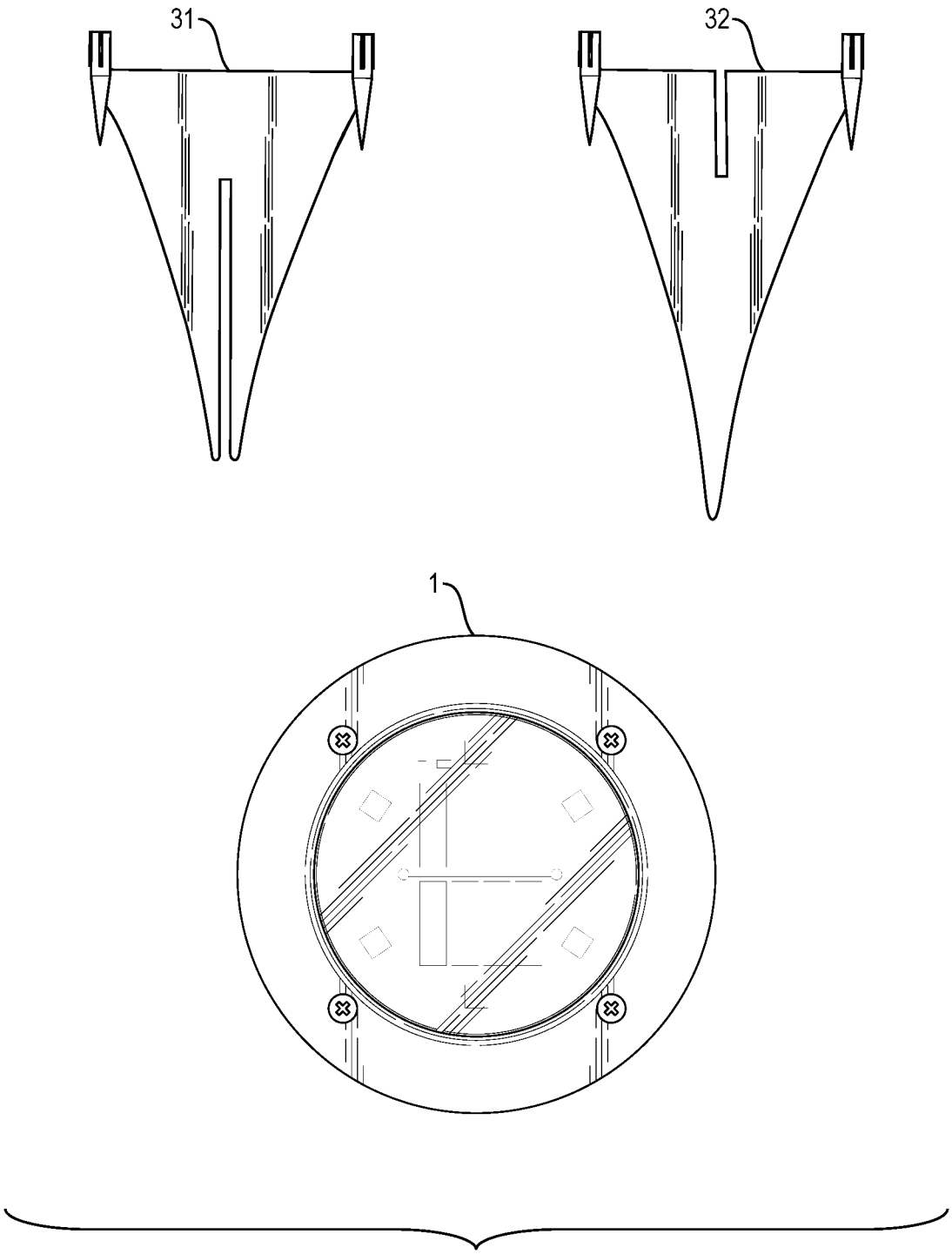
FIG. 1 is a top view of a disk light according to a non-limiting embodiment of the subject technology, together with landscape spikes.

According to a non-limiting aspect of the subject technology, as shown in Figures, disk light 1 comprises a disk light body 10. Disk light body 10 bears solar cells 16 for harvesting solar energy and detecting ambient light. Disk light body 10 comprises hollow housing 11 which is adapted to house rechargeable battery 15 for storing the harvested solar energy, switch 20 for manually operating the light, and wiring and driving electronics (including the electronics disposed on PCB 17) to operatively connect the battery 15, solar cells 16, and switch 20. In an embodiment, lid 18 covers and closes housing 11 and is removable to permit access to the interior components. In this embodiment, solar cells 16 and the LEDs (described below) are disposed on an upper surface of lid 18.

Figure 2:
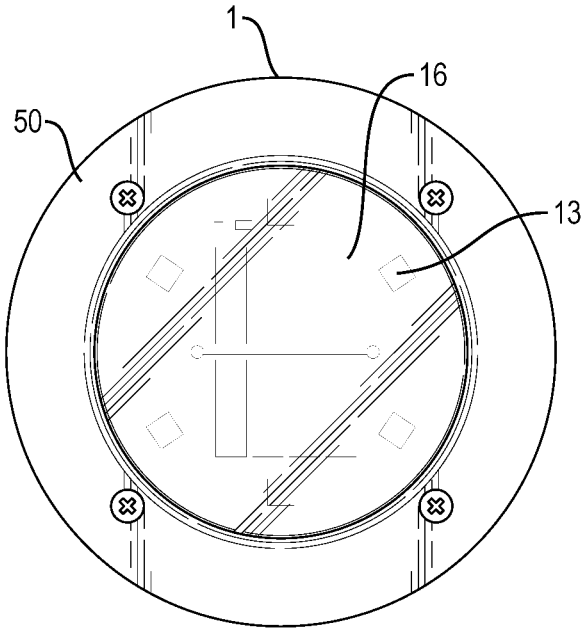
FIG. 2 is a top view of a disk light according to a non-limiting embodiment of the subject technology.
Figure 3:
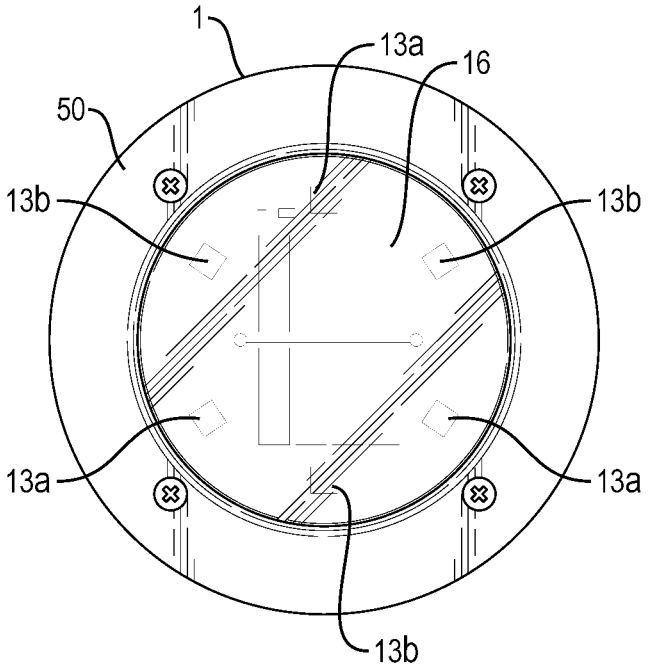
FIG. 3 is a top view of a disk light according to a non-limiting alternative embodiment of the subject technology.
Figure 9:
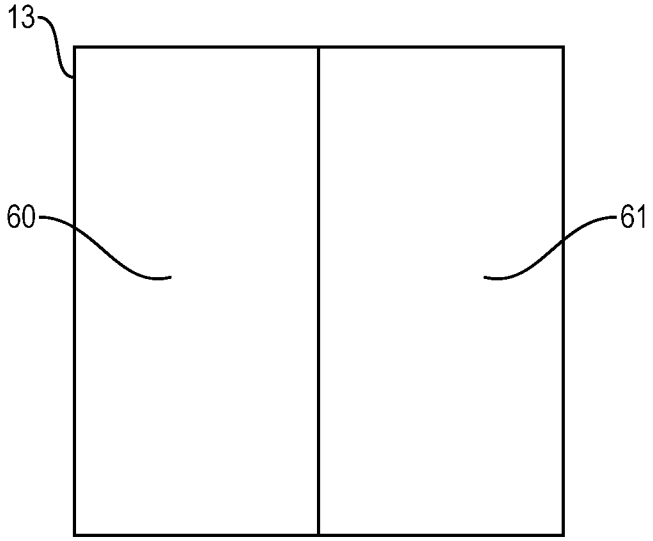
FIG. 9 is a is a schematic view of an LED emitter for emitting cool light or warm light selectively, according to a non-limiting embodiment of the subject technology.

High-power COB or surface mount LEDs 13 (only one is numbered in FIG. 2) for emitting light are disposed on lid 18 and are operatively and electrically connected to battery 15, solar cells 16, switch 20, PCB 17, and the wiring and driving electronics. In the embodiment shown, disk light 1 has six LEDs 13, but in other embodiments may have 1 to 12 LEDs or more. In an embodiment, LEDs 13 are dual-color-temperature LEDs, which emit either warm light or cool light depending on how they are driven. For example, as shown schematically in FIG. 9, LED 13 may have a portion 60 that emits warm light when the LED is driven in a first manner, and a portion 61 that emits cool light when the LED is driven in a second manner. In an alternative embodiment, best seen in FIG. 3, some or all of the LEDs are single-color-temperature LEDs, for example, cool light LEDs 13*a* and warm light LEDs 13*b*, to result in a mixture of cool light LEDs and warm light LEDs.

According to an aspect of the subject technology, the LEDs 13, (or 13*a*, 13*b*), switch 20, and driver electronics are selected, driven and configured to enable the disk light 1 to emit light of various color temperatures, for example, cool light and warm light. Thus, disk light 1 has an OFF mode in which all LEDs are off, a COOL mode in which LEDs are driven to emit cool color temperature light, and a WARM mode in which LEDs are driven to emit warm color temperature light. For this purpose, switch 20 may have three positions, for selecting the OFF mode, COOL mode, and WARM mode.

The switch 20, wiring and driver electronics are configured to deliver electrical power to the LEDs from the battery 15 (thereby driving the LEDs 13 to emit cool temperature light, or alternatively driving cool light LEDs 13*a*) when the switch is in the COOL position and the solar cells 16 are not detecting ambient light; and to deliver electrical power to the LEDs from the battery 15 (thereby driving the LEDs 13 to emit warm temperature light, or alternatively driving warm light LEDs 13*b*) when the switch is in the WARM position and the solar cells 16 are not detecting ambient light and to cut off power to the LEDs (thereby turning the LEDs off) when the switch is in the OFF position or the solar cells 16 are detecting ambient light. The solar cells 16, battery 15, LEDs 13, (or 13*a* and 13*b*), switch 20, and wiring and driver electronics are as known to those of skill in the art.

In an embodiment, shell 50, which may be made of metal or plastic, is disposed on and removably connected to disk light body 10. In this embodiment, clear plastic or glass lens 22 is disposed over lid 18, solar cells 16, and LEDs 13, (or 13*a* and 13*b*), and elastomer seal 21 is disposed in a groove of the light body 10, between body 10 and shell 50, to seal the interior of disk light against moisture.

Figure 4:
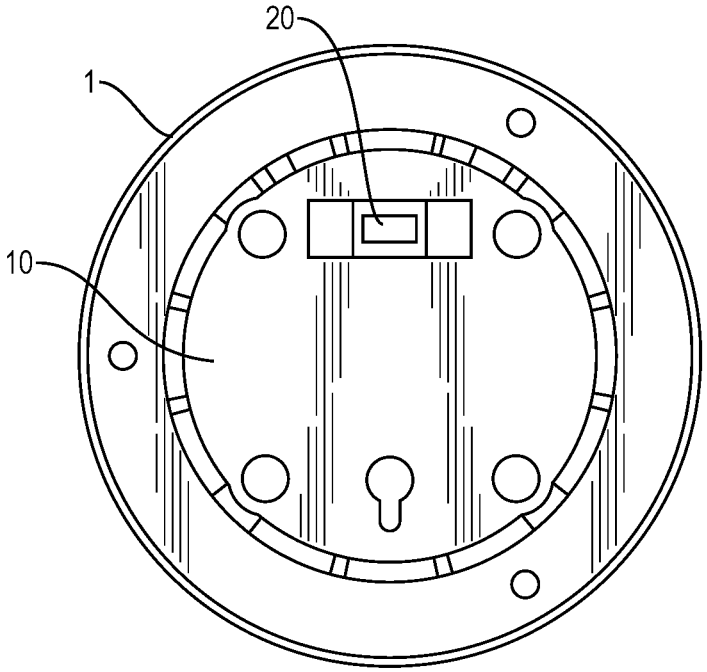
FIG. 4 is a bottom view of the disk light according to a non-limiting embodiment of the subject technology.
Figure 5:
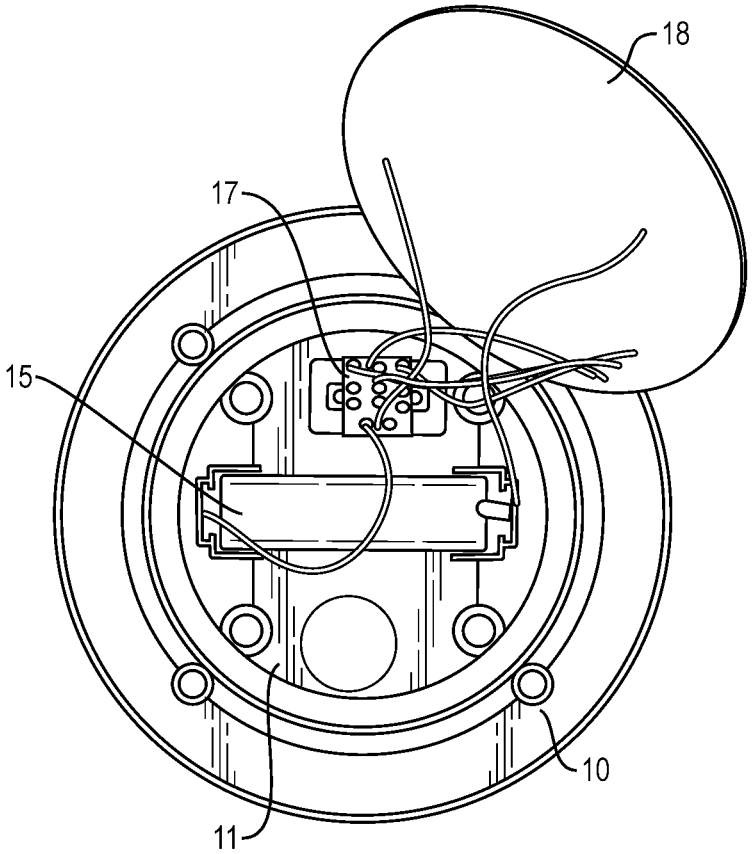
FIG. 5 is a top view of the disk light with the shell and lid removed according to a non-limiting embodiment of the subject technology.
Figure 6:
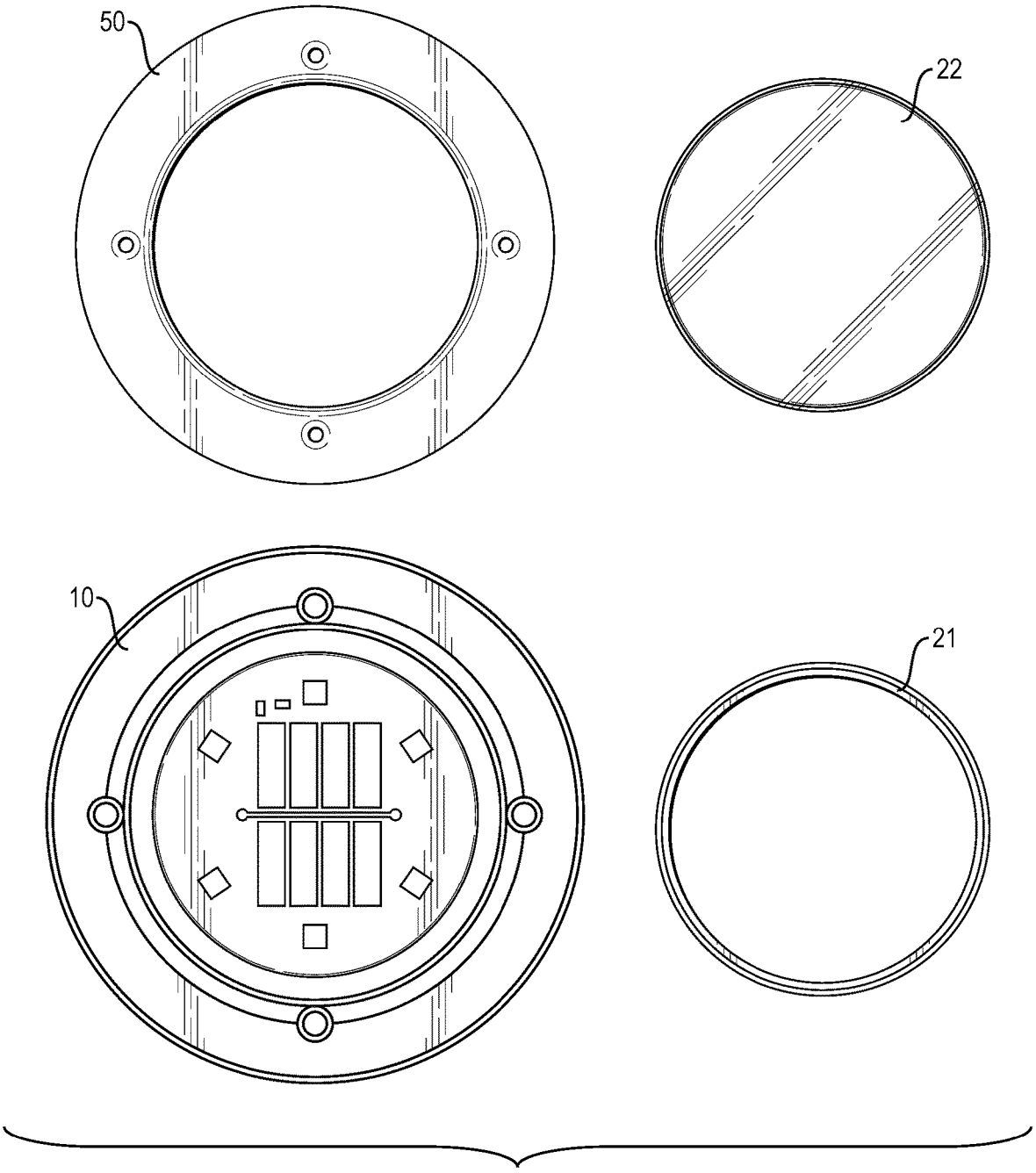
FIG. 6 is a bottom view of the disk light partly disassembled, according to a non-limiting embodiment of the subject technology.
Figure 7:
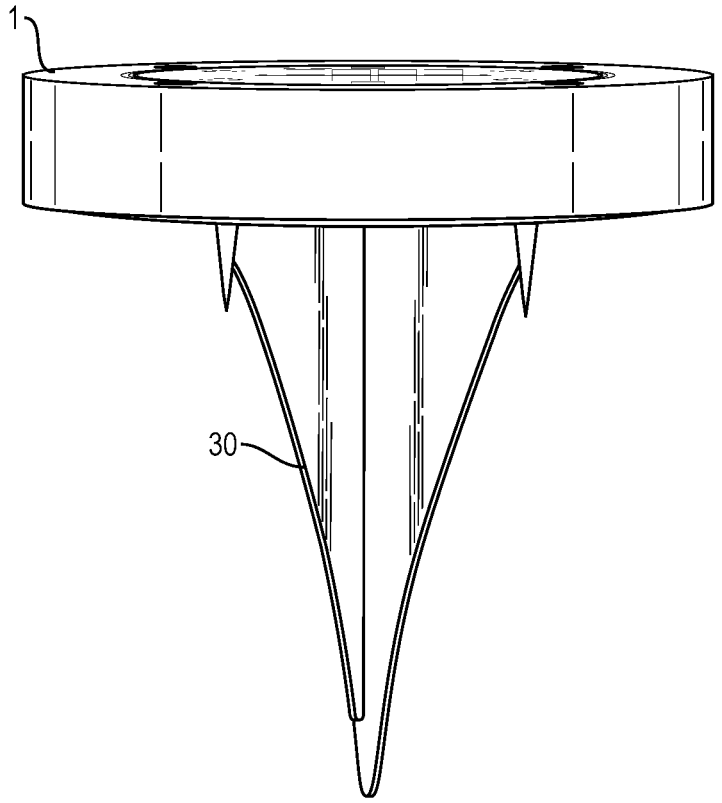
FIG. 7 is a is a side view of the disk light assembled to the landscape spike, according to a non-limiting embodiment of the subject technology.

As best seen in FIG. 4, disk light body 10 has recesses in its bottom surface to permit removable attachment of a landscape spike to disk light 1. As best seen in FIGS. 1 and 7, in the non-limiting embodiment shown, landscape spike 30 is composed of long blade 31 and short blade 32, which are preferably made of metal or plastic. Blades 31, 32 have, respectively, slots for assembling and interlocking the blades together to form spike 30, as shown. Blades 31, 32 have integrally formed pegs for insertion into the recesses to removably attach spike 30 to disk light 1.

According to a non-limiting embodiment of the subject technology, a landscape light kit comprises disk light 1, long blade 31 and short blade 32. The end-user assembles blades 31, 32 to form spike 30, and assembles spike 30 to disk light 1, to form a finished tiltable landscape disk light assembly.

Figure 8:
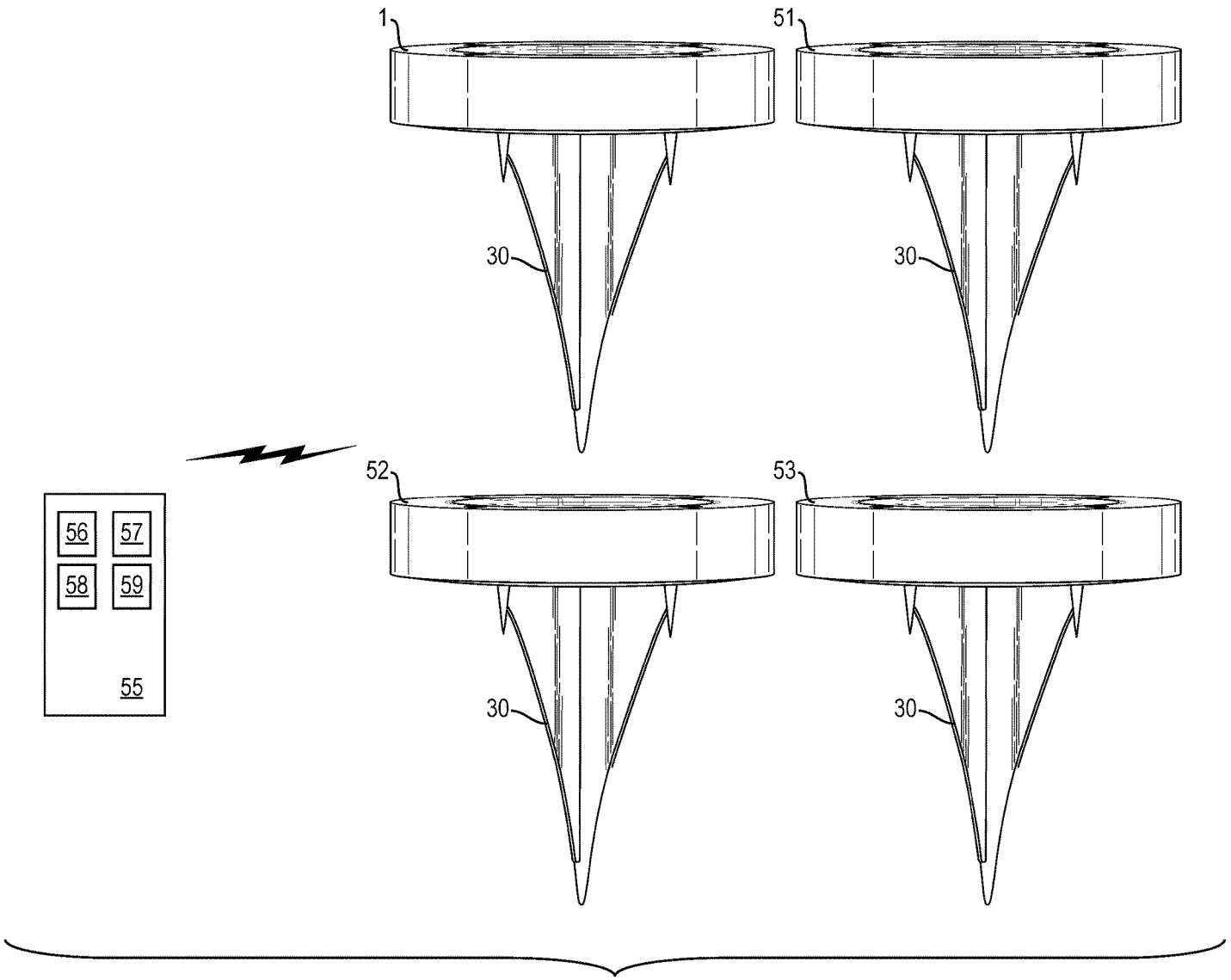
FIG. 8 is a is a schematic view of disk lights assembled to the landscape spikes and under the control of a remote controller, according to a non-limiting embodiment of the subject technology.

In a further embodiment, best illustrated in FIG. 8, a remote-control transmitter 55 associated with disk light 1 and, optionally, additional disk lights, for example disk lights 51, 52, 53, having the same structure and function as disk light 1, are provided. In this embodiment, disk light 1 and, when present, disk lights 51, 52, 53 preferably have a two-position manual switch, the switch having an ON position and an OFF position. When the switch is in the OFF position, the respective lamp is in an All Off mode and none of the LEDs are illuminated. When the switch is in the ON position, the lamp is a Receiving Mode and is responsive to commands received from the remote-control transmitter 55. For this purpose, in this embodiment, the electronic circuitry of disk lights 1, 51, 52, 53 further includes a remote-control receiver, and the electronic circuitry is configured to, when in Receiving Mode, receive signals from the remote-control transmitter 55 and change operating modes of the lamp in response to the signals. The remote-control transmitter 55 and receiver may employ any suitable technology for transmitting and receiving remote-control signals, such as infrared and radio frequency, as non-limiting examples.

In this embodiment, control buttons for operating the remote-control transmitter 55 are disposed on the transmitter. In an embodiment, the buttons comprise an OFF button 56, an ON button 57, a COOL button 58, and a WARM button 59, which, when pressed, send a corresponding remote-control signal to the receivers of disk lights 1, 51, 52, 53, to the extent they are within the range of the transmitter, and the electronic circuitry responds by setting the operating mode of its respective lamp according to the button and signal. In an embodiment, the circuitry responds to the signals as follows: OFF button, All Off mode; COOL button, COOL mode; WARM button, WARM mode; ON button, the most recently used mode of the previous two modes.

It should be understood that the ornamental appearance of the disk lights and components thereof as shown in the Figures are within the scope of the subject technology.

Although the illustrated embodiments are round, the disk lights of the subject technology could be square, triangular, hexagonal, in an irregular shape, the shape of an object in outline (e.g. a flower, butterfly, paw, football) or any shape.

While specific embodiments of the invention have been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention.

What is claimed is:

1. A solar disk light comprising:

a disk light body, the disk light body comprising a housing and a lid over the housing, the housing being hollow to contain components of the disk light;

the disk light body having solar cells on an outer surface thereof for harvesting solar energy and detecting ambient light, and LEDs on an outer surface thereof for emitting light, the LEDs adapted to be selectively driven to emit cool temperature light or warm temperature light;

the disk light body containing lighting components comprising a rechargeable battery for storing harvested solar energy, a switch having an OFF position, a COOL position, and a WARM position for enabling and disabling electrical power delivery to the LEDs from the battery and for selecting the emission of cool temperature light or warm temperature light, and wiring and driver electronics for operably connecting the solar cells, battery, switch, and LEDs;

an annular shell disposed on an integrally-formed annular shelf of the disk light body and removably connected to the annular shelf by fasteners, the annular shell having a round opening therein such that the lid, solar cells, and LEDs are exposed through the round opening, the annular shell having an outer wall disposed to surround the disk light body; and an elastomer seal disposed in a groove of the disk light body, between the disk light body and the shell, for sealing the interior of disk light against moisture;

the wiring and driver electronics configured to deliver electrical power to the LEDs from the battery, and configured to drive some or all of the LEDs to emit cool temperature light when the switch is in the COOL position and the solar cells are not detecting ambient light, and configured to drive some or all of the LEDs to emit warm temperature light when the switch is in the WARM position and the solar cells are not detecting ambient light, and to cut off power to the LEDs when the switch is in the OFF position or the solar cells are detecting ambient light.

2. The solar disk light of claim 1 further comprising a landscape spike removably attached to the disk light body, the landscape spike configured for insertion into the ground, thereby affixing the solar disk light to the ground.

3. The solar disk light of claim 1 wherein the LEDs are dual-color-temperature LEDs.

4. The solar disk light of claim 1 wherein a first portion of the LEDs are cool light LEDs and a second portion of the LEDs are warm light LEDs.

5. A kit for making a solar disk light assembly, the kit comprising a solar disk light according to claim 1, and a pair of blades configured to be interlocked together to form a landscape spike which is configured to be removably attached to the disk light body and also configured for insertion into the ground, thereby affixing the solar disk light to the ground.

6. A solar disk light comprising:

a disk light body, the disk light body comprising a housing and a lid over the housing, the housing being hollow to contain components of the disk light;

the disk light body having solar cells on an outer surface thereof for harvesting solar energy and detecting ambient light, and LEDs on an outer surface thereof for emitting light, the LEDs capable of being selectively driven to emit cool temperature light or warm temperature light;

the disk light body containing lighting components comprising a rechargeable battery for storing harvested solar energy, a switch having an OFF position and an ON position, and a remote-control receiver for receiving remote-control signals from a remote-control transmitter configured to send remote-control signals to the remote-control receiver, the remote-control signals including an ON remote-control signal, a COOL remote-control signal, a WARM remote-control signal, and an OFF remote-control signal;

an annular shell disposed on an integrally-formed annular shelf of the disk light body and removably connected to the annular shelf by fasteners, the annular shell having a round opening therein such that the lid, solar cells, and LEDs are exposed through the round opening, the annular shell having an outer wall disposed to surround the disk light body; and an elastomer seal disposed in a groove of the disk light body, between the disk light body and the shell, for sealing the interior of disk light against moisture;

the wiring and driver electronics configured to deliver electrical power to the LEDs from the battery, and configured to drive some or all of the LEDs to emit cool temperature light when the switch is in the ON position and the solar cells are not detecting ambient light and the remote-control receiver has received a COOL remote-control signal from the remote-control transmitter, and configured to drive some or all of the LEDs to emit warm temperature light when the switch is in the ON position and the solar cells are not detecting ambient light and the remote-control receiver has received a WARM remote-control signal from the remote-control transmitter, and to cut off power to the LEDs when the switch is in the OFF position or the solar cells are detecting ambient light or the remote-control receiver has received an OFF remote-control signal from the remote-control transmitter.

7. The solar disk light of claim 6 further comprising a landscape spike removably attached to the disk light body, the landscape spike configured for insertion into the ground, thereby affixing the solar disk light to the ground.

8. The solar disk light of claim 6 wherein the LEDs are dual-color-temperature LEDs.

9. The solar disk light of claim 6 wherein a first portion of the LEDs are cool light LEDs and a second portion of the LEDs are warm light LEDs.

10. A kit for making a solar disk light assembly, the kit comprising a solar disk light according to claim 6, and a pair of blades configured to be interlocked together to form a landscape spike which is configured to be removably attached to the disk light body and also configured for insertion into the ground, thereby affixing the solar disk light to the ground, the kit further including the remote-control transmitter.

* * * * *